US006705815B1

(12) United States Patent
Bennett et al.

(10) Patent No.: US 6,705,815 B1
(45) Date of Patent: Mar. 16, 2004

(54) SELF-FEEDER FOR THE HANDICAPPED

(75) Inventors: John E. Bennett, Rancho Palos Verdes, CA (US); Willis C. Bradley, Gardena, CA (US)

(73) Assignee: Lenjoy Engineering, Inc., Gardena, CA (US)

( * ) Notice: Subject to any disclaimer, the term of this patent is extended or adjusted under 35 U.S.C. 154(b) by 308 days.

(21) Appl. No.: 09/704,636

(22) Filed: Nov. 2, 2000

(51) Int. Cl.[7] ..... A47G 21/08
(52) U.S. Cl. ..... 414/9; 414/733
(58) Field of Search ..... 414/9, 733, 744.3, 414/744.6, 917

(56) References Cited

U.S. PATENT DOCUMENTS 3,885,681 A * 5/1975 Mancino ..... 414/9
4,433,950 A * 2/1984 Hanger et al. ..... 414/9
4,522,543 A * 6/1985 Robinson ..... 414/9
5,037,261 A * 8/1991 Morewood ..... 414/9

OTHER PUBLICATIONS

Brochure—Neater Eater—Michaelis Engineering, 68 Argyle Road, Southampton S02 0BQ Website information, http://www.michaeli.u–net.com/neater.htm Michaelis Engineering Ltd. and Neater Solutions Ltd., 13 Spencer Road, Buxton, Derbyshire, SK17 9DX, England.

* cited by examiner

*Primary Examiner*—Janice L. Krizek
(74) *Attorney, Agent, or Firm*—Natan Epstein

(57) ABSTRACT

A feeding device for use by persons with limited or no use of their arms, wherein a spoon is mounted on supporting and counterbalancing levers and is associated with a mouthpiece in such a manner that the user can manipulate the spoon to lift food from a dish, can then place the spoon on a fixed support and then adjust the spoon to a position for convenient eating of the food. The spoon mounting includes an adjustable support for a counterbalancing spring. All the parts are mounted on a flat base which is adapted also to support the food dish.

28 Claims, 4 Drawing Sheets

SELF-FEEDER FOR THE HANDICAPPED

BACKGROUND OF THE INVENTION

1. Field of the Invention

This invention pertains to the field of aids for the physically handicapped and more particularly concerns a self-feeder device designed to hold a spoon on a damped arm above a food bowl to allow persons suffering from tremors, neurological problems or weakness in the upper extremities to better feed themselves.

2. State of the Prior Art

Persons suffering from a wide range of neurological and other conditions including multiple sclerosis, cerebral palsy, Parkinson's disease, Huntingdon's disease, head injuries, rheumatoid arthritis and muscular dystrophies may experience great difficulty in performing simple manual tasks due to loss of fine motor control over their extremities, and may in fact become unable to use eating utensils in order to feed themselves. Hand and arm tremors caused by these diseases prevent close control over eating utensils so that the person is unable to keep food on a spoon long enough to lift the food to his or her mouth, or to even maneuver the spoon into his or her open mouth, due to loss of dexterity. Persons in such a condition are likely to drop and spill food and are humiliated in the presence of others by their inability to feed themselves. In many these symptoms are sufficiently severe that the persons become largely dependent upon others to feed them, with severe negative impact on the afflicted individual's self-esteem. Either friends or family must make themselves available for this purpose, or professional help must be retained at considerable cost. In either case a considerable burden, personal or economic, is imposed by the need to care for the handicapped individual.

There is a need for devices, tools or aids which can assist moderately impaired persons afflicted with conditions such as just described to feed themselves without the assistance of third persons, in order to restore these persons to a measure of independence and self-sufficiency.

Electrically operated self-feeders are available but are costly and generally intended for more severely incapacitated persons. The applicant is aware of one self-feeder powered by the user and provided with a damped arm and a self-leveling spoon for use by persons with tremors or weakness of the upper extremities. Nonetheless, further improvements and refinements in user powered self-feeders are needed.

SUMMARY OF THE INVENTION

In response to the aforementioned need this invention provides a self-feeder for the handicapped, having a base, an upright support on the base, and a cross arm supported on the upright support for rotation about a vertical axis thereby to swing the cross arm horizontally and also supported for pivotal movement in a vertical plane thereby to raise and lower a free end of the cross arm. A spoon holder is supported near the free end of the cross arm for pivotal movement in the same vertical plane relative to the cross arm. A linkage mechanism is operative for keeping the spoon holder in a constant, e.g. vertical position during pivotal movement of the cross arm in the vertical plane. A mechanical spring is contained in the upright support and urges the cross arm to a maximally elevated position. A one way damper is also located in the upright support, and is effective in slowing the speed of the rising cross arm.

Consequently, a spoon attached to the spoon holder may be lowered by pushing down the cross arm against the force of the spring for scooping food from a food bowl placed on the base, and the cross arm may be then released to an elevated position under urging of the spring to raise the spoon to the mouth of a user while keeping the spoon level to avoid spilling the food from the spoon.

The upright support may be telescopically assembled to and can be slidably removable from a base post affixed to the base, such that the upright support together with the cross arm can be readily disassembled from the base for compact storage of the self-feeder. For example, the upright support can be a vertical tube slidably fitted on a base post affixed to the base, with the upright support freely rotatable about the base post for horizontal rotation of the cross arm. The spring and damper are preferably contained in the vertical tube, and the cross arm is pivoted to the tube at a location radially spaced from the center axis of the tube, and the damped mechanical spring is compressed between the tube and the cross arm along the center axis of the tube, whereby an upward bias is applied by the spring to the cross arm.

The cross arm has two mutually opposite walls vertical to the base, a first shaft between the opposite walls for pivoting the arm to the upright support, a second shaft between the opposite walls for pivoting the spoon holder to the arm. The linkage mechanism includes a linkage rod having one end pivoted to the upright support at a location spaced from the first shaft and a second end pivoted to the spoon holder at a location spaced from the second shaft thereby to form a parallelogram arrangement for keeping the spoon holder in a constant attitude relative to the base during pivotal movement of the cross arm.

It is desirable to provide first stop means adjustable for setting the maximally elevated position of the cross arm under upward urging by the spring, and second stop means adjustable for limiting left and right horizontal swing of the cross arm.

The spoon is supported transversely to the arm in the spoon holder for oscillation in the vertical plane independently of the cross arm. More specifically, the spoon holder has an upper portion pivoted to the cross arm for movement in the vertical plane independently of the cross arm and a lower portion including spoon retaining means, the lower portion being pivoted to the upper portion for oscillation relative to the upper portion between a normal vertical condition corresponding to a level position of the spoon and an elevated position corresponding to an inclined position of said spoon. The spoon has a spoon handle adapted for releasable retentive engagement to the spoon retaining means of the spoon holder.

Optionally, a handle may be rigidly affixed to the lower portion of the spoon holder for use in lifting the lower portion of the spoon holder from a vertical position to a tilted position, thereby to move a spoon retained to the lower portion between a level and an inclined position to assist in dipping the spoon into a serving of food. The lower portion of the spoon holder is returned to the normal vertical position from the tilted position by its own weight. Retentive engagement of the spoon handle may be on either a left side or a right side of the cross arm for ambidextrous left hand or right hand use of the self-feeder, respectively. The spoon holder may also be attached to the cross arm with the longitudinal dimension of the spoon aligned with the cross arm instead of at right angles thereto.

The self-feeder further has a turntable rotatable on the base for supporting a food bowl under the spoon holder.

Preferably the turntable has a raised edge for holding a plate placed on the turntable against sliding off the turntable during self-feeding. It is also desirable to provide a slip resistant top surface for restraining a plate against sliding across the turntable surface during self-feeding.

The turntable is displaceable across the base for optimum positioning relative to the spoon holder. For example, a slide plate is slidable on the base, the turntable is rotatably fixed to the slide plate, and a fastener is provided for releasably locking the slide plate to the base in a selected position. The fastener is adjustable between a fully locked first position for locking the slide plate against movement relative to the base, a selective locking second position wherein the glide plate is free to turn about the fastener relative to the base, and a released third position wherein the slide plate is also free to slide radially to the fastener. More particularly, the fastener has a knob on a shaft threaded to the base, and the fully locked first position corresponds to a fully tightened condition of the knob against the slide-plate thereby to capture the slide plate between the knob and the base, the selective locking second position is a partially tightened condition of the knob against the slide plate, and the released position is a loosely tightened condition of the knob against the slide plate.

DETAILED DESCRIPTION OF THE PREFERRED EMBODIMENTS

Figure 1:
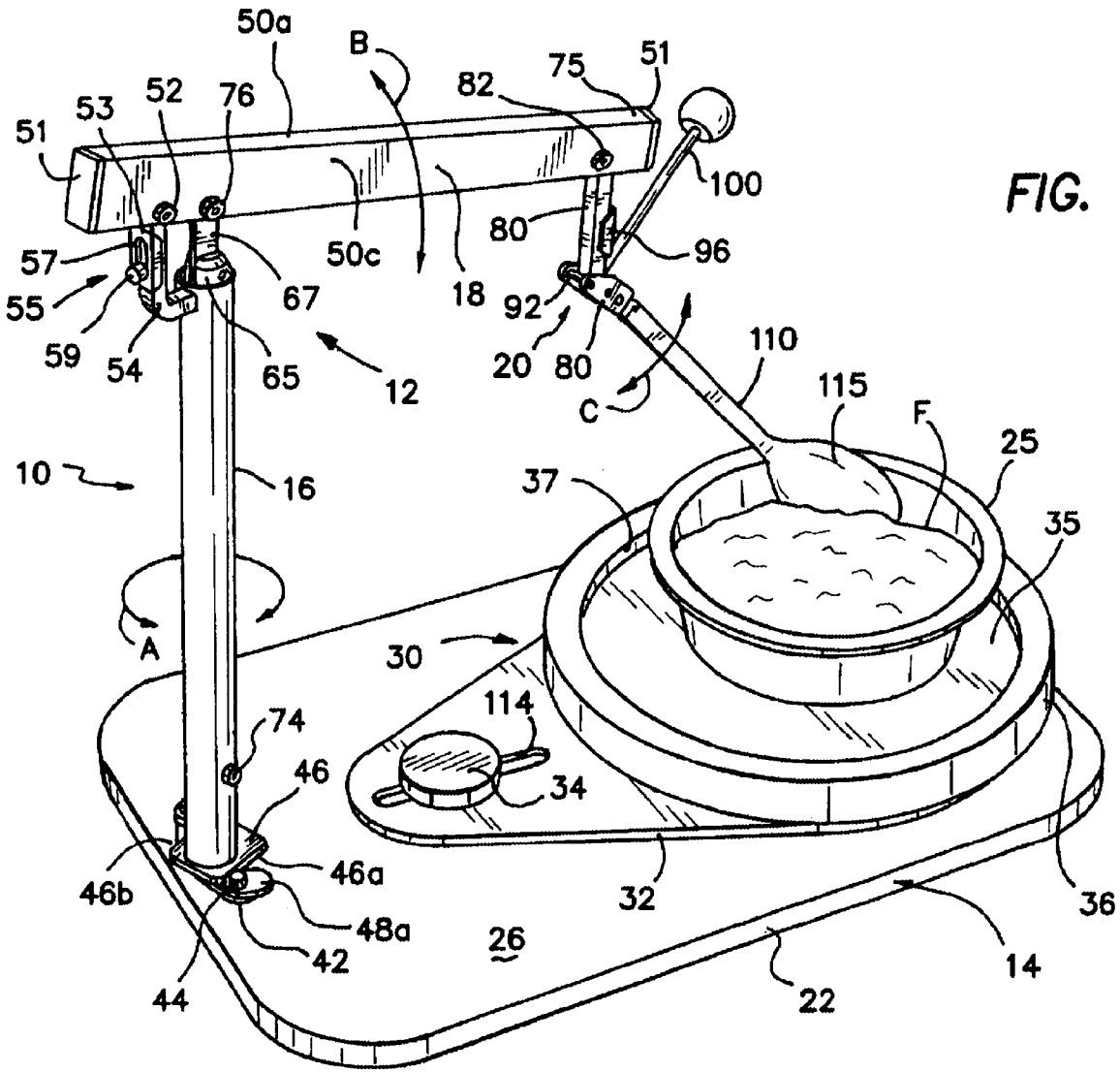
FIG. 1 is a perspective view of the self-feeder of this invention.

With reference to the accompanying drawings wherein like elements are designated by like numerals, FIG. 1 illustrates a presently preferred embodiment of the self-feeder of this invention, which is generally designated by the numeral 10. The self-feeder 10 consists of two main assemblies: the feeding arm assembly 12 and the base assembly 14. The feeding arm assembly includes an upright support in the form of a vertical tube 16, a cross arm 18 and a spoon holder assembly 20. The base assembly includes a base plate 22 which rests on four equal feet 24 of slip-resistant material. The base 22 has a top surface 26 on which is supported a turntable assembly 30, which includes a slide plate 32, a slide plate fastener 34, and a turntable 36. The base assembly also includes a base post 38 with a mounting flange 42 fastened to the base plate 22 by two screws 44. A food bowl 25 is supported on turntable 36.

Figure 2:
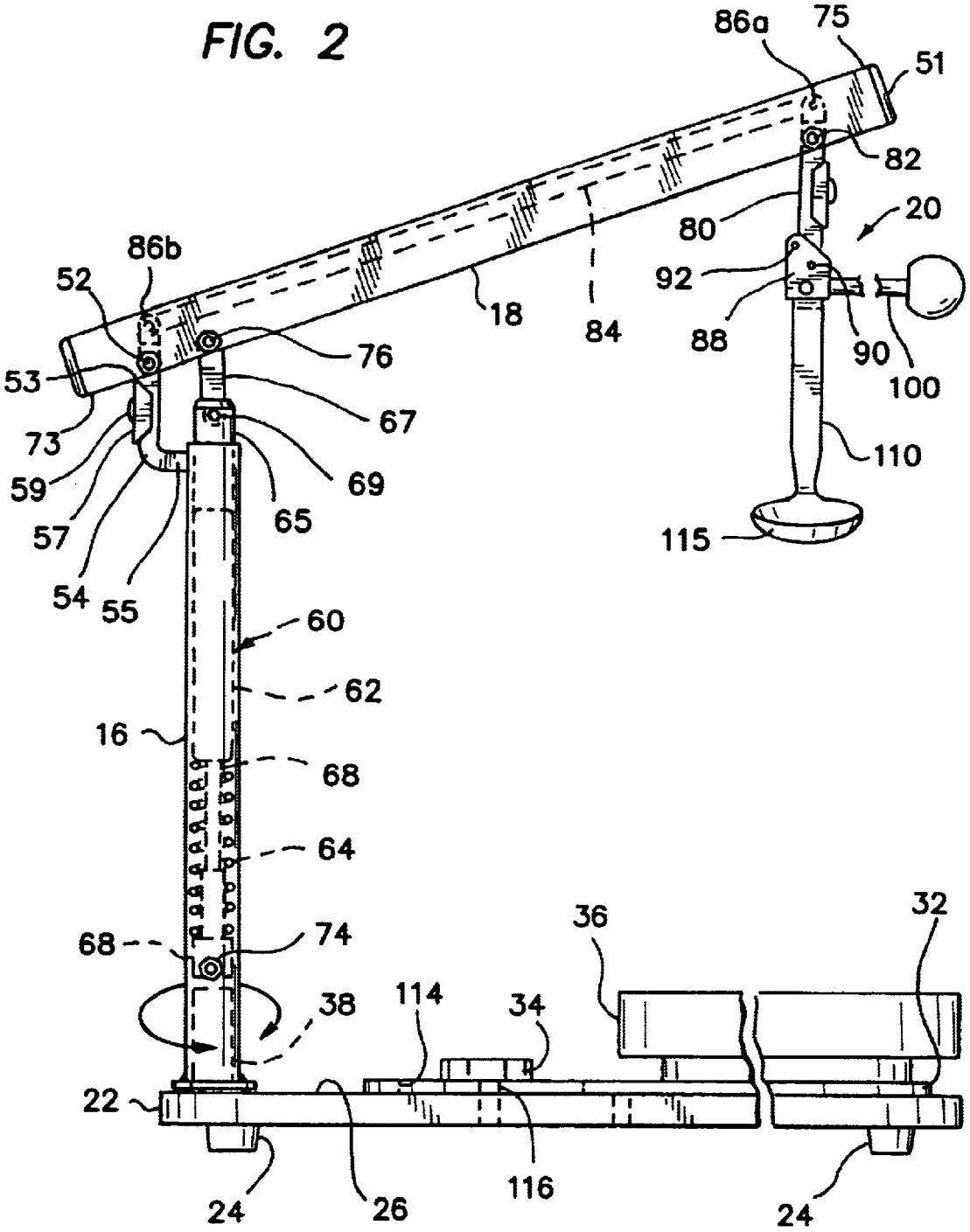
FIG. 2 is a side elevational view of the self-feeder of FIG. 1 showing in phantom lining the spoon leveling mechanism in the cross arm and the spring assembly contained in the arm support column.
Figure 3:
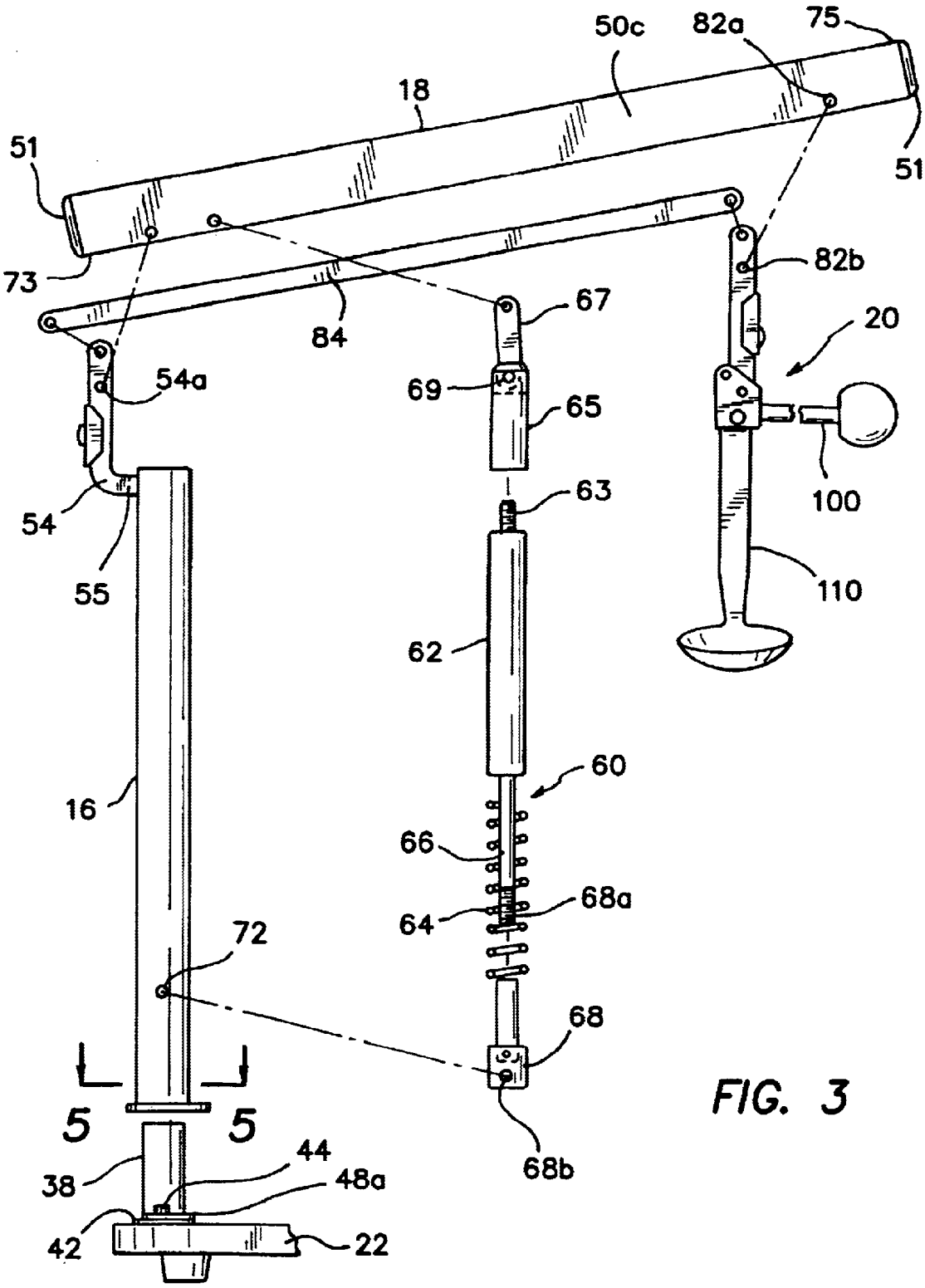
FIG. 3 is an exploded view of the feeder arm assembly of the self-feeder of FIG. 1.
Figure 5:
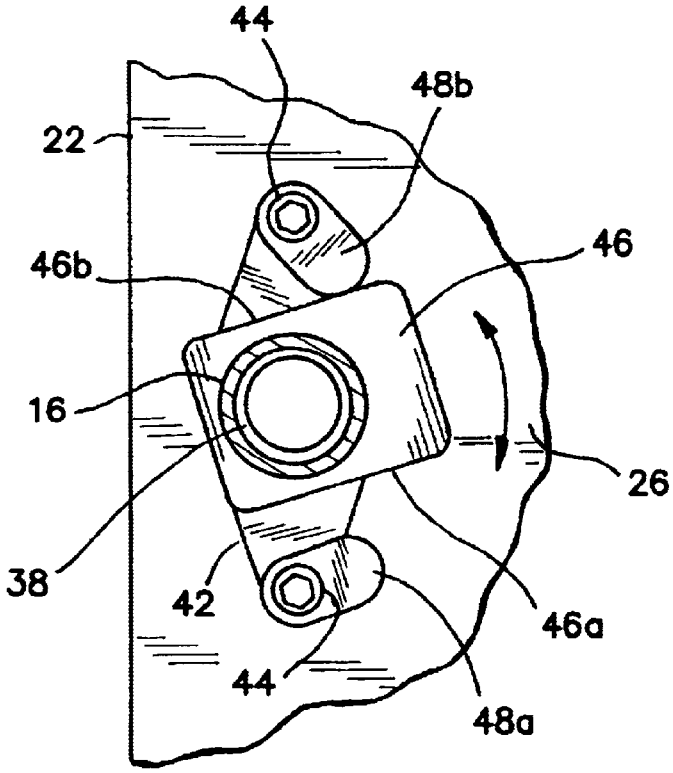
FIG. 5 is a sectional view taken along lines 5—5 in FIG. 3.

The feeding arm assembly 12 is assembled to the base assembly 14 by a telescoping sliding fit of the vertical tube 16 onto the base post 38, as best understood from FIGS. 2 and 3. Tube 16 is freely rotatable about base post 38, that is, about the vertical center axis of the base post. Rotation of tube 16 is limited, however, by a base flange 46 fixed as by welding to the lower end of tube 16. Base flange 46 has two opposite right and left contact edges 46*a*, 46*b* each of which contacts a corresponding right and left stop lug 48*a*, 48*b* fastened to the base plate by screws 44, as shown in FIG. 5. The stop lugs are of elongated shape and can be turned about the corresponding screw 44 to provide an adjustable stop for limiting the arc of rotation H of the vertical tube 16 about the base post 38 in either sense of rotation indicated by arrow A in FIG. 1.

The cross arm 18 is a straight beam of rectangular cross sectional shape which includes a top 50*a* and two opposite side walls 50*b*, 50*c*. A first pivot shaft 52 supported between side walls 50*b,c* pivots the cross arm 18 for oscillation in a vertical plane to the upper end of the vertical tube 16 by way of a supporting elbow 54. The lower end of elbow 54 is welded to the tube 16 close to the upper end of the tube. Pivot shaft 52 passes through a lower hole 54*a* in elbow 54, as indicated in FIG. 3, and pivotably supports the arm 18 in radially spaced relationship to the center axis of tube 16.

As shown in FIG. 2 the vertical tube 16 contains a damped spring assembly 60, which as best seen in FIG. 3 includes a damper cylinder 62 and a coil spring 64, both cooperating to urge a piston rod 66 toward extension from the cylinder 62 at a controlled rate. An end block 68 is threaded to the end 68*a* of the piston rod, and the coil spring is compressed between the end block and the cylinder 62. The end block has a screw hole 68*b* which aligns with hole 72 in vertical tube 16 to receive screw 74. Screw 74 supports the spring within tube 16 in spaced relationship above the base post 38, as best understood by reference to FIG. 2. The damper cylinder 62 is a one way damper which has a controlled rate of extension of the damper piston rod 66 such that the damper works to control the rate of upward movement of the cross arm under the urging of the coil spring 64. The damper cylinder is a commercially available unit and has at its top end a threaded shaft 63. A coupling 65 is threaded onto shaft 63. A spring transfer arm 67 has a lower end pivoted at 69 to the top of coupling 65. The upper end of the spring transfer arm is pivoted by pivot shaft 76 to the cross arm 18 approximately along the center axis of tube 16. The damped spring assembly 60 is compressed between the cross arm 18 and the vertical tube 16 and operates to apply a continuous upward spring bias to the cross arm along a vector approximately aligned with the center axis of tube 16. This spring bias vector is spaced along cross arm 18 from the first pivot shaft 52 and consequently acts to raise the free end 75 of cross arm 18 towards a maximum elevation determined by an adjustable elevation stop 55 on elbow 54. Elevation stop 55 includes a detent tab 57 slidable along the upright arm of elbow 54 and fixed to the elbow at an adjustable position by means of set screw 59. The upper edge 53 of detent tab 57 contacts the underside of cross arm 18 to stop downward movement of the cross arm end 73 corresponding to upward movement of the opposite free end 75 of the cross arm. As a result, lowering of detent tab 57 along elbow 54 results in an increase in maximum height of the free end 75 under the urging of spring assembly 60. Conversely, maximum elevation of the cross arm is reduced by raising the position of detent tab 57 on elbow 54.

Figure 4:
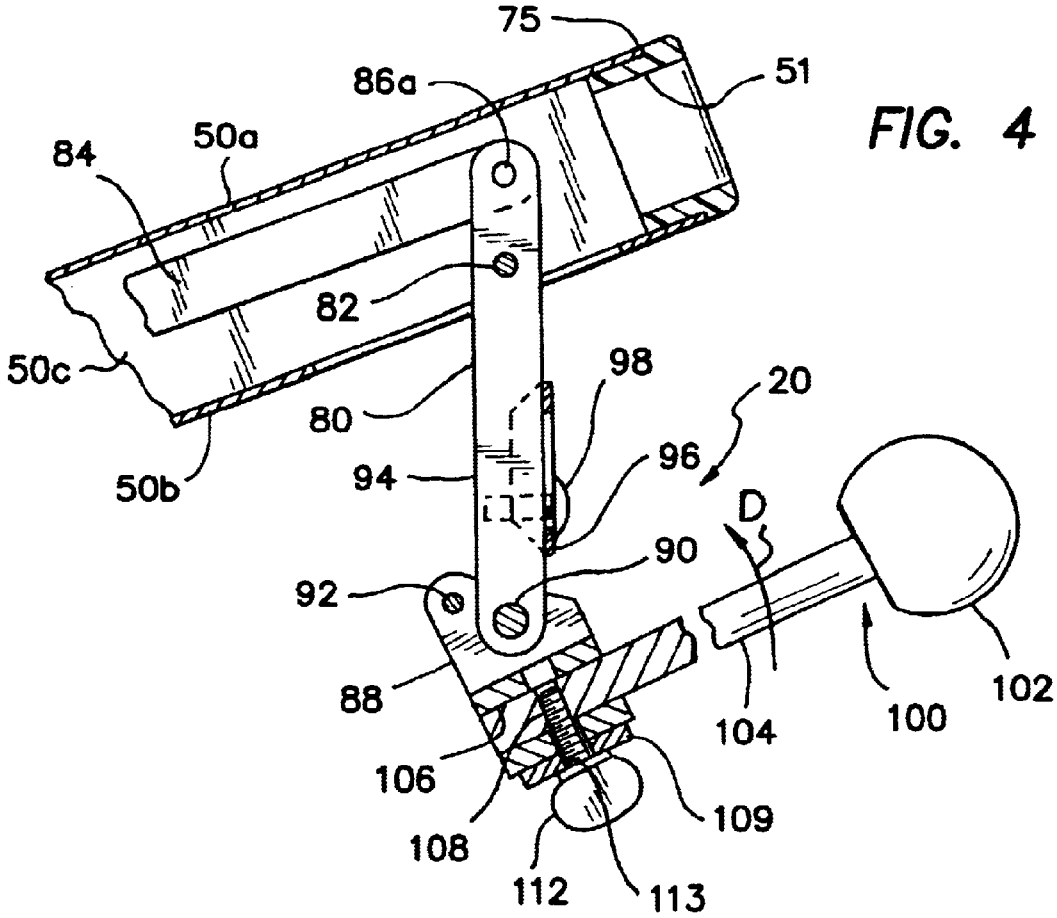
FIG. 4 is a cross-sectional detail view of the spoon holder assembly.

The spoon holder assembly 20 includes an upper portion or arm 80 pivoted to arm 18 by third pivot shaft 82 supported in holes 82*a* in side walls 50*c* of the cross arm, and passing through lower hole 82*b* in arm 80 of the spoon holder assembly. The upper end of arm 80 is connected by way of cross linkage 84 to the upper end of elbow 54, by means of pivots 86*a*, 86*b* respectively. The four pivots 52, 86*b*, 86*a* and 82 define a parallelogram arrangement which operates to keep the upper portion 80 of the spoon holder assembly in a constant attitude, e.g. a vertical relationship, to the base 22 during pivotal movement of the cross arm 18 in the vertical plane. Turning to FIG. 4, spoon holder assembly 20 also includes a lower portion 88 which is dependent from the upper portion 80 and pivoted at 90 for oscillation in the same vertical plane as the cross arm 18. Oscillation of lower portion 88 is limited, in a clockwise sense, by stop pin 92 which is located so as to stop the lower portion 88 in vertical alignment with the upper portion 80 by contact of pin 92 with the inside edge 94 of the upper portion 80. Counter-clockwise oscillation of lower portion 88 is limited by adjustable detent 96 which is displaceable along upper portion 80 and set in a selected position therealong by tightening set screw 98. The lower portion tends to return under its own weight to a normal condition limited by pin 92, and must be manually lifted to an elevated or tilted condition such as depicted in FIG. 4. Lifting of the lower portion 88 as suggested by arrow D is aided by handle 100 which has a handle knob 102 and a handle shaft 104 fitted into a handle bore 106 of lower portion 88 and retained in the handle bore by spoon screw 108. A spoon 110 is removably secured to the underside of lower portion 88 also by spoon screw 108. The flat spoon handle 109 is captured between the head 112 of screw 108 and the underside of lower portion 88, with the longitudinal dimension of the spoon transversely to the cross arm 18, either on the left or the right hand side of the cross arm. For this purpose the spoon handle may have a short slot 113 sized to receive the threaded shaft of screw 108. The spoon can therefore be easily detached from the feeder for washing or replacement with a different sized spoon simply by loosening the screw 108. The spoon screw holds the spoon with the bowl 115 of the spoon level when the lower portion 88 of the spoon holder is in its normal lowered position. As earlier explained, the lower portion 88 drops to the lower position under its own weight, so that the spoon attached to the lower portion 88 is self leveling relative to the upper portion 80 of the spoon holder. The upper portion 80, as also explained, is kept in a vertical condition at all times independently of vertical cross arm movement. The net result of both these actions is that the spoon remains level for any position of the cross arm unless the spoon is deliberately lifted to an inclined condition by the user in the course of self-feeding.

Turning to FIGS. 1 and 2, the circular turntable 36 is mounted for-free rotation on a slide plate 32. The slide plate has a slot 114 through which extends a threaded shaft 116 fixed to the base 22, as suggested in phantom lining in FIG. 2. A slide plate fastener knob 34 screws onto the upper end of threaded shaft 116 and can be tightened against the slide plate 32 so as to press the slide plate against the base 22 and thus capture and lock by frictional engagement the slide plate against displacement relative to the base 22. In a normal, tightened condition of fastener 34 the slide plate 32 and consequently the turntable 36 are fixed on the base 22. However, the position of the turntable relative to the spoon can be adjusted by loosening fastener 34, which allows the slide plate to be displaced towards or away from the vertical tube 16 along the slot 114, and also by rotation of the plate 32 about the shaft 116 so as to move the turntable and consequently the food bowl 25 across the base 22 transversely to the cross arm 18, thereby to optimally position the turntable for a given food bowl size and to suit the preferences of the user. The top surface 35 of the turntable 36 is covered with a sheet of material selected to resist slippage of the food bowl 25 across the turntable. Furthermore, the turntable has a relatively high rim 37 to ensure that the food bowl 25 is not pushed off the turntable during self-feeding. The various features described in this paragraph allow interchangeable use of different food bowls to suit the user's preferences or the particular food being served, and to adapt to use of existing institutional food bowls, so that the self-feeder is not restricted to custom food bowls.

For self-feeding use the user is seated at a table or other surface with the feeder 10 placed on the supporting surface directly in front of the user and the cross arm extending left to right in front of the user. The vertical tube 16 is positioned to the left of a right-handed user or on the right hand side of a left handed user to facilitate access by the user's dominant hand to the spoon holder 20. The spoon 110 is attached to the lower portion 88 of the spoon holder assembly 20 accordingly, i.e., extending from the cross arm 18 towards the user regardless of the left or right hand placement of the self-feeder 10 relative to the user. The self-feeder 10 is readily adapted to either right or left hand use simply by reversing the position of the spoon on the spoon holder from one side to the other of the cross arm 18 by loosening spoon screw 108, turning the spoon about the screw shaft, and tightening the screw. The height adjustment 55 is preset so that the spoon rises to the level of the user's mouth when the cross arm is released. The two stop lugs 48*a*, 48*b* are set to prevent the cross arm from swinging further away from the user than is necessary to adequately reach all parts of the food bowl with the spoon, yet allow the cross arm to swing towards the user so as to bring the spoon within comfortable reach of the user's mouth. The settings of the right and left stop lugs 48*a*, 48*b* are therefore dependent, among other factors, on whether the self-feeder is being set-up for right or left handed use.

In an initial before-use position of the feeder 10 the cross arm 18 will be elevated to the preset maximum height, as depicted in FIG. 2. A bowl or plate 25 containing a serving or portion of food F is placed on the turntable surface 37 generally underneath-the spoon 110, as illustrated in FIG. 1. The user will push down on either on the cross arm 18 or handle 100 to depress the free end 75 while at the same time rotating the cross arm towards or away from him or her self, so as to position the spoon 110 for dipping into the food serving F. The bowl of the spoon 110 is loaded with food by lifting the spoon to a tilted position as shown in FIG. 1, by lifting the handle 100, and maneuvering the cross arm both in the vertical and the horizontal plane so as to bring the bowl of the spoon into contact with food serving F. The spoon is then lowered through an arc C in FIG. 1, as by pushing down on the handle 100, to dip the spoon bowl into the food F until the spoon bowl 115 reaches a level position corresponding to a vertical condition of the lower portion 88 of the spoon holder, that is, a condition where further depression of the handle 100 is stopped by detent pin 92. At this point, the spoon bowl 115 can be lifted from the food serving F, now loaded with a spoonful of food, by releasing the cross arm 18 which then rises away from the food bowl 25 under the upward urging of the spring assembly 60. The action of the coil spring 64 is damped by the damper cylinder 62 to ensure a relatively slow and steady vertical movement of the cross arm 18, both up under the urging of spring assembly 60 as well as down under the pressure of the user's hand. The user typically operates the cross arm 18 and handle 100 with his dominant hand, and may hold onto vertical tube 16 with his or her other hand to further stabilize the self-feeder. Alternatively, the dominant hand may operate handle 100 to lower the cross arm and to load food onto the spoon, and the other hand used to swing the cross arm towards and away from the user.

As the cross arm rises under spring bias the weight of the spoon keeps the lower portion 88 of the spoon holder in lowered position and the spoon level, as previously explained and shown in FIGS. 2 and 3. The cross arm 18 rises to its maximum preset elevation with the spoon bowl 115 aiming towards the user, who can then bring the spoon bowl 115 towards his or her mouth by swinging the cross arm 18 in a horizontal plane, that is, by turning the cross arm with vertical tube 16 about the base post 38, into sufficient proximity where the user can comfortably take the bowl of the spoon with the spoonful of food into his or her mouth. Once the user has transferred the spoonful of food from the spoon bowl to his or her mouth, the empty spoon is again loaded with another spoonful of food by repeating the aforementioned sequence of steps.

It will be appreciated that the self-feeder disclosed above offers three separate degrees of movement of the spoon available to the user; a) rotation of the cross-arm about a vertical axis permits horizontal swinging of the cross arm b) pivotal movement of the cross arm in the vertical plane allows the cross arm to swing up or down vertically, and c) oscillation of the spoon relative to the cross arm in a direction transverse to both the vertical swing and horizontal swing of the cross arm. These three degrees of freedom, indicated in FIG. 1 by arrows A, B and C respectively, facilitate the self-feeding process.

The damped vertical movement of the cross-arm 18 of the self-feeder 10 compensates in large measure for tremors or poor muscular control of the upper extremities, while the upward bias of the cross arm lifts the spoon to a safe height if the user is unable to hold it and lets go of the cross arm during feeding, thereby preventing dropped spoons and spilled food which would likely result if the handicapped user attempted to feed himself or herself in a conventional manner by handholding the spoon without mechanical assistance.

While a preferred embodiment of the invention has been shown and illustrated for purposes of clarity and illustration, it must be understood that many changes, substitutions and modifications to the described embodiment will be apparent to those having only ordinary skill in the art, and that the scope of the invention is limited only by the scope of the following claims.

What is claimed is:

1. A self-feeder for the handicapped, comprising:

a base;

an upright support on said base;

a cross arm supported on the upright support for rotation about a vertical axis thereby to swing said cross arm horizontally, and further supported for pivotal movement in a vertical plane thereby to raise and lower a free end of said cross arm;

a spoon holder supported near said free end for pivotal movement in said vertical plane relative to said cross arm and a control handle attached to said spoon holder for use in pivoting said spoon holder by a user;

a linkage mechanism operative for maintaining said spoon holder in a constant attitude relative to the base during said pivotal movement of said cross arm in said vertical plane; and a spring contained in said upright support and urging said cross arm to a maximally elevated position and a one way damper for controlling the rate of upward movement of said cross arm under said urging;

whereby a spoon held on said spoon holder may be lowered by pushing down on said cross arm or said control handle against the force of said spring for scooping food from a food bowl on said base and the cross arm may then be released to an elevated position under said spring urging to raise said spoon to the mouth of a user while keeping the spoon level to avoid spilling the food from the spoon.

2. The self-feeder of claim 1 wherein said upright support is a tube vertically mounted on said base and said spring and said damper are contained in said tube, said cross arm is pivoted at a location spaced from said tube, and said spring is compressed between said tube and said cross arm.

3. The self-feeder of claim 1 wherein said cross arm has two mutually opposite walls vertical to said base, a first shaft between said opposite walls for pivoting said cross arm to said upright support, a second shaft between said opposite walls for pivoting said spoon holder to said arm, said linkage mechanism comprising a linkage rod having one end pivoted to said upright support at a location spaced from said first shaft and a second end pivoted to said spoon holder at a location spaced from said second shaft, thereby to form a parallelogram arrangement for keeping the spoon holder in said constant attitude during pivotal movement of said arm.

4. The self-feeder of claim 1 further having first stop means adjustable for setting said maximally elevated position.

5. The self-feeder of claim 1 further comprising second stop means adjustable for limiting the horizontal swing of said cross arm.

6. The self-feeder of claim 1 wherein said upright support is telescopically assembled to and slidably removable from a base post affixed to said base, such that said upright support and said cross arm can be readily disassembled from said base for compact storage of the self-feeder.

7. The self-feeder of claim 6 wherein said upright support is freely rotatable about said base post for horizontal rotation of said cross arm.

8. The self-feeder of claim 1 further comprising a spoon having a spoon handle adapted for releasable retentive engagement to said spoon holder transversely to said arm.

9. The self-feeder of claim 8 wherein said retentive engagement of said spoon handle may be on either a left side or a right side of said arm for ambidextrous left hand or right hand use of the self-feeder, respectively.

10. The self-feeder of claim 1 wherein said spoon is supported in said spoon holder for oscillation in said vertical plane independently of said cross arm.

11. The self-feeder of claim 10 wherein said spoon holder has an upper portion pivoted to said cross arm for movement in said vertical plane independently of said cross arm and a lower portion including spoon retaining means, said lower portion pivoted to said upper portion for oscillation relative to said upper portion between a normal vertical condition corresponding to a level position of said spoon and an elevated position corresponding to an inclined position of said spoon.

12. The self-feeder of claim 11 wherein said control handle is rigidly affixed to said lower portion of the spoon holder for use in lifting said lower portion of the spoon holder from said vertical position to said elevated position, thereby to move a spoon retained to said lower portion between a level and an inclined position to assist in dipping the spoon into a serving of food.

13. The self-feeder of claim 11 wherein said lower portion of the spoon holder is returned to said normal vertical position from said elevated position by its own weight.

14. The self-feeder of claim 1 further comprising a turntable rotatable on said base for supporting a food bowl under said spoon holder.

15. The self-feeder of claim 14 wherein said turntable has a raised edge for holding a plate placed on said turntable against sliding off the turntable during self-feeding.

16. The self-feeder of claim 14 wherein said turntable has a slip resistant top surface for restraining a plate against sliding across said surface during self-feeding.

17. The self-feeder of claim 14 wherein said turntable is displaceable across said base.

18. The self-feeder of claim 17 further comprising a slide plate slidable on said base, said turntable being rotatably fixed to said slide plate, and a fastener for releasably locking the slide plate to the base in a selected position.

19. The self-feeder of claim 18 wherein said fastener is adjustable between a fully locked position for locking said slide plate against movement relative to the base, a selective locking position wherein said slide plate is free to turn about said fastener relative to the base, and a released position wherein said slide plate is also free to slide radially to said fastener.

20. The self-feeder of claim 19 wherein said fastener comprises a knob on a shaft threaded to said base, and said fully locked position corresponds to a fully tightened condition of said knob against said slide plate thereby to capture the slide plate between the knob and the base, said selective locking position is a partially tightened condition of said knob against said slide plate, and said released position is a loosely tightened condition of the knob against the slide plate.

21. A self-feeder for the handicapped, comprising:

a base;

an upright support on said base;

a cross arm supported on the upright support for rotation about a vertical axis thereby to swing said cross arm horizontally, and further supported for pivotal movement in a vertical plane thereby to raise and lower a free end of said cross arm;

a spoon holder supported near said free end of said cross arm;

a spoon having a spoon handle adapted for releasable retentive engagement to said spoon holder transversely to said cross arm on either a left side or a right side of said cross arm for ambidextrous left hand or right hand use of the self-feeder, respectively;

a linkage mechanism operative for maintaining said spoon holder in a constant attitude relative to the base during said pivotal movement of said cross arm in said vertical plane; and a spring for urging said cross arm to a maximally elevated position;

such that a spoon held on said spoon holder may be lowered by pushing down said cross arm against the force of said spring for scooping food from a food bowl on said base and the cross arm may then be released to an elevated position under said spring urging to raise said spoon to the mouth of a user while keeping the spoon level to avoid spilling the food from the spoon.

22. The self-feeder of claim 21 wherein said spoon is supported in said spoon holder for oscillation independently of said cross arm between a level position of said spoon and an inclined position of said spoon.

23. The self-feeder of claim 22 further comprising a handle rigidly affixed to said spoon holder for use in manually lifting said spoon between a level and an inclined position to assist in dipping the spoon into a serving of food.

24. The self-feeder of claim 23 wherein said spoon holder is operative for allowing said spoon to return to said level position from said inclined position under the weight of the spoon.

25. The self-feeder of claim 22 further comprising a turntable rotatable on said base for supporting a food bowl under said spoon holder.

26. The self-feeder of claim 25 wherein said turntable is displaceable across said base for repositioning a food bowl placed thereon in relation to said spoon holder, and a fastener for releasably securing said turntable to the base in a selected position.

27. A self-feeder for the handicapped, comprising:

a base;

an upright support telescopically assembled to and slidably removable from a base post affixed to said base;

a cross arm supported on the upright support, said upright support being rotatable about said base post about a vertical axis thereby to swing said cross arm horizontally, said cross arm being further supported on said upright support for pivotal movement in a vertical plane thereby to raise and lower a free end of said cross arm, said upright support and said cross arm being readily disassembled from said base for compact storage of the self-feeder;

a spoon holder supported near said free end of said cross arm for pivotal movement in said vertical plane relative to said cross arm and a handle attached to said spoon holder for use in pivoting said spoon holder relative to the cross arm;

a linkage mechanism operative for maintaining said spoon holder in a constant attitude relative to the base during said pivotal movement of said cross arm in said vertical plane;

wherein said upright support is a tube vertically mounted on said base and said cross arm is pivoted at a location radially spaced from a center axis of said tube; and a spring contained in said tube and compressed between said tube and said cross arm for urging said cross arm to a maximally elevated position and a damper for controlling the rate of upward movement of said cross arm under said urging;

such that a spoon held in said spoon holder may be lowered by pushing down on said cross arm or said handle against the force of said spring for scooping food from a food bowl on said base and the cross arm may then be released to an elevated position under said spring urging to raise said spoon to the mouth of a user while keeping the spoon in a constant attitude to avoid spilling the food from the spoon.

28. The self-feeder of claim 27 wherein said cross arm is tubular and said linkage mechanism is contained interiorly to said cross arm.

* * * * *